US005593315A

United States Patent [19]

Kinoshita et al.

[11] Patent Number: 5,593,315

[45] Date of Patent: Jan. 14, 1997

[54] CONNECTOR READILY ASSEMBLED WITH A CABLE ACCURATELY POSITIONED WITHOUT USING TOOLS

[75] Inventors: Hiroaki Kinoshita; Tadashi Ishiwa, both of Tokyo, Japan

[73] Assignee: Japan Aviation Electronics Industry, Limited, Japan

[21] Appl. No.: 413,627

[22] Filed: Mar. 30, 1995

[30] Foreign Application Priority Data

Mar. 31, 1994 [JP] Japan ..... 6-063414

[51] Int. Cl.[6] ..... H01R 13/58

[52] U.S. Cl. ..... 439/459; 439/401; 439/404

[58] Field of Search ..... 439/459, 460, 439/456, 470, 464, 471, 404, 401

[56] References Cited

U.S. PATENT DOCUMENTS

| | | | |
|---|---|---|---|
| 3,920,306 | 11/1975 | Barnett, Jr. et al. | 439/459 |
| 4,632,489 | 12/1986 | Skinner | 439/459 |
| 4,749,369 | 6/1988 | Wang | 439/459 |
| 4,822,286 | 4/1989 | Bianca | 439/460 |
| 4,875,875 | 10/1989 | Archer et al. | 439/456 |
| 5,217,389 | 6/1993 | MacKay et al. | 439/459 |
| 5,244,415 | 9/1993 | Marsilio et al. | 439/456 |

*Primary Examiner*—Gary F. Paumen
*Assistant Examiner*—T. C. Patel
*Attorney, Agent, or Firm*—Laff, Whitesel, Conte & Saret, Ltd.

[57] ABSTRACT

A connector is connected to a cable composed of a plurality of electric wires, each of which comprises a metal wire covered with an insulator, and a sheath provided with an opening formed at its terminal end and covering the electric wires with one end portions of the electric wires projecting from the opening. The connector comprises an insulating base member, a plurality of conductive contact elements fixedly supported in the base member, and an insulating cover member removably coupled to the base member and covering terminal portions of the contact elements respectively connected to the metal wires. The cover member comprises an electric wire positioning portion for holding terminal ends of the one end portions of the electric wires so that the terminal ends confront the contact elements corresponding thereto, respectively, and a cable holding portion for holding the cable at an end portion of the sheath adjacent the opening.

7 Claims, 7 Drawing Sheets

CONNECTOR READILY ASSEMBLED WITH A CABLE ACCURATELY POSITIONED WITHOUT USING TOOLS

BACKGROUND OF THE INVENTION

This invention relates to a connector connected to a cable and, in particular, to a connector having a structure adapted for use as an interface connector for connecting a central processing unit (CPU) and a peripheral device.

A conventional connector of the type described is connected to a cable composed of a plurality of electric wires, each of which comprises a metal wire covered with an insulator, and a sheath provided with an opening formed at its terminal end and covering the electric wires with one end portion of each of the electric wires projecting from the opening.

The conventional connector comprises an insulating base member, a plurality of conductive contact elements, and two insulating cover members. The contact elements are fixedly supported in the base member. The cover members are removably coupled to the base member. The cover members cover terminal portions of the contact elements respectively connected to the metal wires.

In the conventional connector of the type described, the base member, the cover members, and an end portion of the cable adjacent the base member are covered with an outer cover made of plastic. The outer cover is formed by a molding process. In order to form the outer cover in a desired shape, it is necessary to hold the cable in such a condition that the sheath is accurately positioned with respect to the cover members. This has been realized by the use of two conventional methods described below.

A first method uses a back shell base made of metal. The back shell base comprises a body and a clamp member formed at one end of the body. The body covers one surfaces of the base member and the cover members. The clamp member holds the cable at an end portion of the sheath adjacent its opening. The back shell base is combined with a back shell cover made of metal and a front shell cover made of metal. The back shell cover covers the other surfaces of the base member and the cover members. The front shell cover covers a top end portion of the base member.

According to the first method, the top end portion of the base member is at first covered with the front shell cover. Then, the base member and the cover members are covered with the back shell base and the back shell cover. Subsequently, the cable is held by the clamp member of the back shell base in a condition wherein the sheath is accurately positioned with respect to the cover members. Thereafter, the outer cover is formed to surround the back shell base and the back shell cover.

However, the first method has a problem which will presently be described. When the base member and the cover members are covered with the back shell base and the back shell cover according to the first method, a number of jigs are required to position these components with respect to one another. Likewise, a number of jigs are again required to hold the cable by the clamp member of the back shell base. Thus, in the first method, the connector can not easily be assembled because a number of jigs are inevitably required.

On the other hand, a second method of holding the cable with the sheath accurately positioned with respect to the cover members includes a primary molding process preliminarily carried out prior to molding of the outer cover. In this primary molding process, a first plastic cover is formed to cover the base member, the cover members, and the end portion of the cable adjacent the base member. According to the second method, the first cover serves to hold the cable with the sheath accurately positioned with respect to the cover members. After the cable is held by the first cover as described above, the outer cover is formed to surround the first cover.

However, the second method has a problem which will presently be described. Specifically, the primary molding process in the second method requires a number of tools such as dies, jigs, and pins for positioning the sheath. Thus, in the second method, the connector can not easily be assembled because a number of tools are inevitably required.

SUMMARY OF THE INVENTION

In view of the above-mentioned problems in prior art, it is an object of this invention to provide a connector which is capable of easily and accurately holding a cable in a condition where an end portion of a sheath adjacent an opening thereof is accurately positioned with respect to a cover member without using tools such as jigs, dies, and pins, without using a shell, and without carrying out a primary molding process so as to simplify a manufacturing process of the connector and to reduce a manufacturing cost of the connector.

A connector to which this invention is applicable is connected to a cable composed of a plurality of electric wires, each of which comprises a metal wire covered with an insulator, and a sheath provided with an opening formed at its terminal end and covering the electric wires with one end portions of the electric wires projecting from the opening. The connector comprises an insulating base member, a plurality of conductive contact elements fixedly supported in the base member, and an insulating cover member removably coupled to the base member and covering terminal portions of the contact elements respectively connected to the metal wires. According to this invention, the cover member comprises an electric wire positioning portion for holding terminal ends of the one end portions of the electric wires so that the terminal ends confront the contact elements corresponding thereto, respectively, and a cable holding portion for holding the cable at an end portion of the sheath adjacent the opening.

DESCRIPTION OF THE PREFERRED EMBODIMENT

Figure 1:
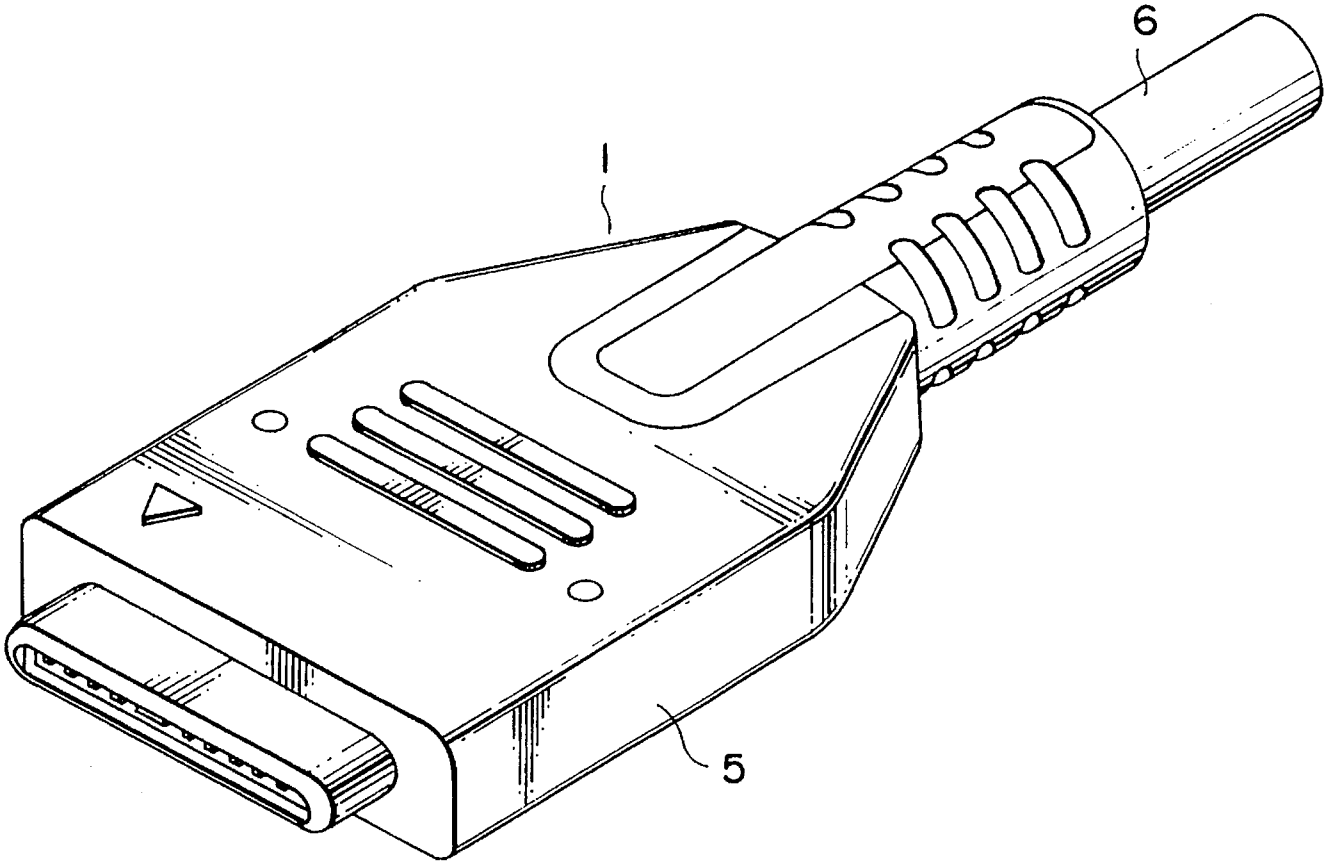
FIG. 1 PRIOR ART
FIG. 1 is a perspective view of a conventional interface connector.
Figure 2:
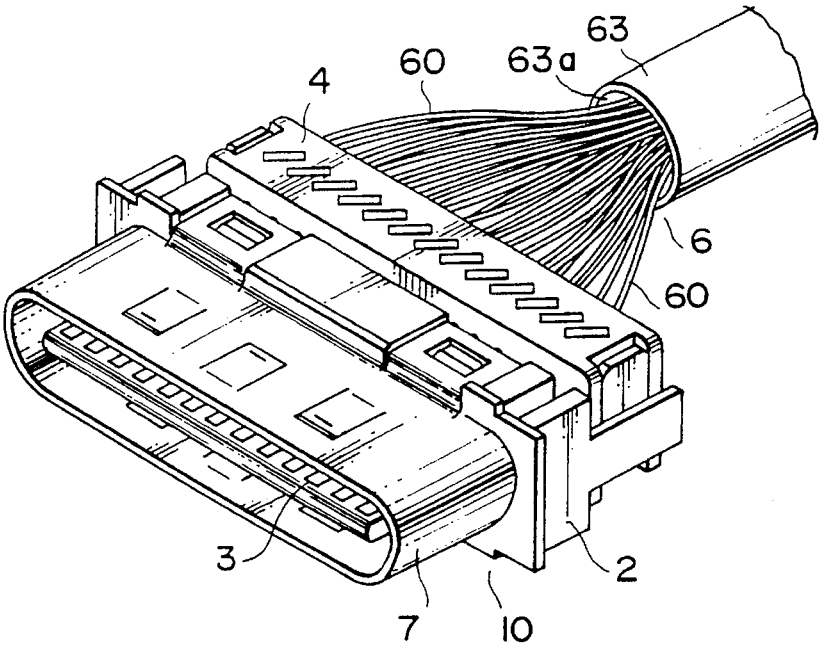
FIG. 2 PRIOR ART
FIG. 2 is a perspective view of a connector body of the interface connector illustrated in FIG. 1.
Figure 3:
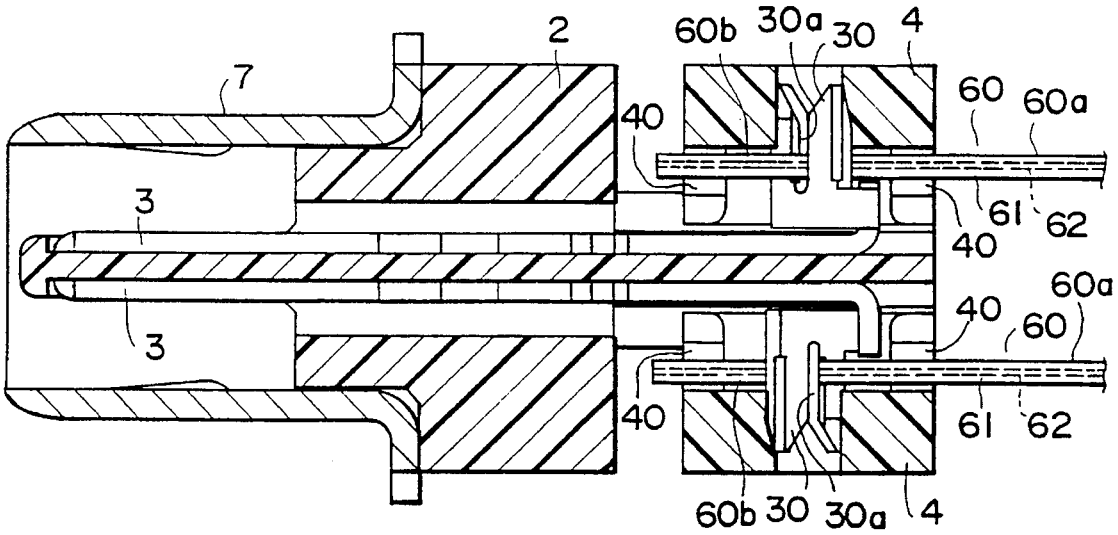
FIG. 3 PRIOR ART
FIG. 3 is a longitudinal sectional view of the connector body illustrated in FIG. 2.

For a better understanding of this invention, description will at first be made as regards a conventional connector with reference to the drawing.

Referring to FIGS. 1 through 4, a conventional connector 1 is an interface connector and comprises an insulating base member 2, a plurality of conductive contact elements 3, two cover members 4, and an insulating outer cover 5.

The connector 1 is connected to a cable 6 composed of a plurality of electric wires 60, each of which comprises a metal wire 62 covered with an insulator 61, and a sheath 63 provided with an opening 63*a* formed at its terminal end and covering the electric wires 60 with one end portions 60*a* of the electric wires 60 projecting from the opening 63*a*.

Each of the contact elements 3 has a terminal portion 30. The terminal portion 30 has a slot portion 30*a*. The terminal portion 30 is brought into contact with the metal wire 62 of the electric wire 60 once the insulator 61 is cut by the slot portion 30*a*. With this structure, each contact element 3 is called a U-contact element or an insulation displacement contact (IDC). The contact elements 3 are fixedly supported in the base member 2 with their terminal portions 30 projecting therefrom. The cover members 4 are removably coupled to the base member 2 in a longitudinal direction of the terminal portions 30. Each of the cover members 4 covers the terminal portion 30 of the contact element 3 connected to the metal wire 62. Each of the cover members 4 has an electric wire positioning portion 40. The electric wire positioning portion 40 holds terminal ends 60*b* of the one end portions 60*a* of the electric wires 60 projecting from the opening 63*a* of the sheath 63 so that the terminal ends 60*b* confront the contact elements 3 corresponding thereto, respectively.

Figure 4A:
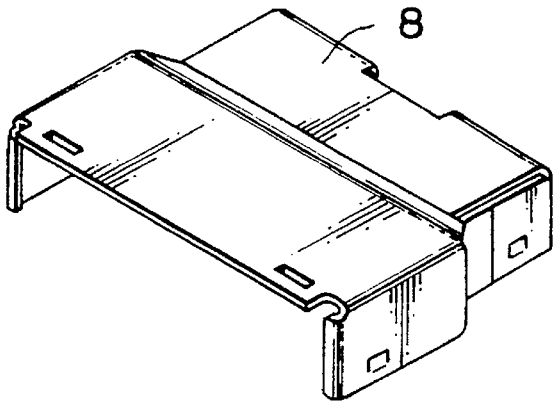
FIG. 4A PRIOR ART
FIGS. 4(*a*) and 4(*b*) are perspective views of a back shell cover and a back shell base which cover the connector body illustrated in FIG. 2, respectively.
Figure 4B:
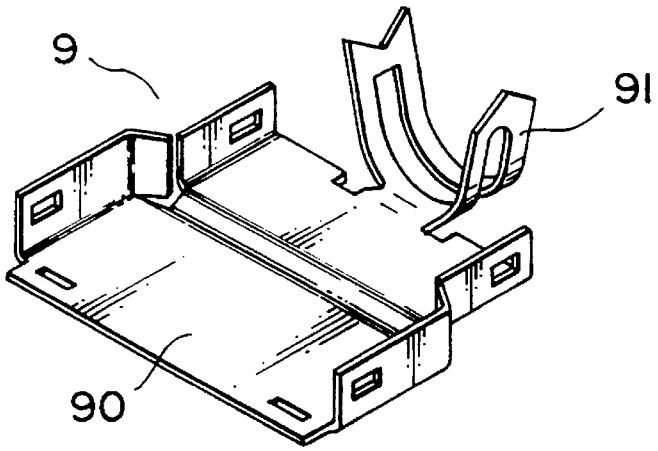
FIG. 4B PRIOR ART

In the conventional connector 1, the above-mentioned first method is used to hold the cable 6. Accordingly, the conventional connector 1 further comprises a front shell cover 7 made of metal (FIGS. 2 and 3), a back shell cover 8 made of metal (FIG. 4), and a back shell base 9 made of metal (FIG. 4). The front shell cover 7 is attached to a top end portion of the base member 2 to cover the top end portion. The back shell cover 8 covers upper surfaces of the base member 2 and one of the cover members 4. The back shell cover 8 has side walls engaged with the back shell base 9. The back shell base 9 has a body 90 and a clamp member 91. The body 90 covers lower surfaces of the base member 2 and the other cover member 4 as well as side surfaces of the base member 2 and the both cover members 4. The clamp member 91 holds the cable 6 at an end portion of the sheath 63 adjacent the opening 63*a*.

As described above, the outer cover 5 is formed by a molding process after the base member 2 and the cover members 4 are covered with the front shell cover 7, the back shell cover 8, and the back shell base 9 and the cable 6 is held by the clamp member 91 of the back shell base 9. The outer cover 5 covers the base member 2, the cover members 4, and one end portion of the cable 6.

Next referring to FIGS. 5 through 9, description will now be made as regards a connector according to one embodiment of this invention. Similar parts are designated by like reference numerals as those described in conjunction with the conventional connector.

A connector 1 according to this embodiment is an interface connector and comprises a base member 2, a plurality of contact elements 3, a cover member 4, and an outer cover 5 in the manner similar to the conventional connector illustrated in FIGS. 1 through 4(*a*) and 4(*b*).

The base member 2 has engaging portions 20 formed at both sides thereof to be engaged with the cover member 4. The base member 2 is preferably made of synthetic resin (for example, polyamide resin).

The contact elements 3 may be made of phosphor bronze, beryllium copper, or Cu—Ni—Sn alloy. Each contact element 3 is an IDC. Accordingly, each contact element 3 has a terminal portion 30 provided with a slot portion 30*a*. The contact elements 3 are arranged in two rows within the base member 2 with their terminal portions 30 projecting therefrom. When the base member 2 and the cover member 4 are coupled to each other, the slot portions 30*a* of the contact elements 3 cut insulators of electric wires 60 of a cable 6 held by the cover member 4 to be brought into press contact with metal wires of the electric wires 60, respectively.

Figure 6A:
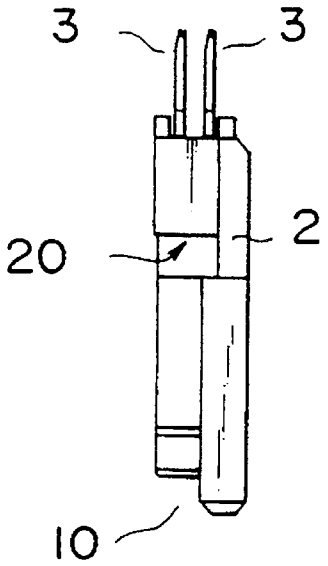
FIGS. 6(*a*) and 6(*b*) are a side view and a plan view of a connector body of the interface connector illustrated in FIG. 5, respectively.
Figure 6B:
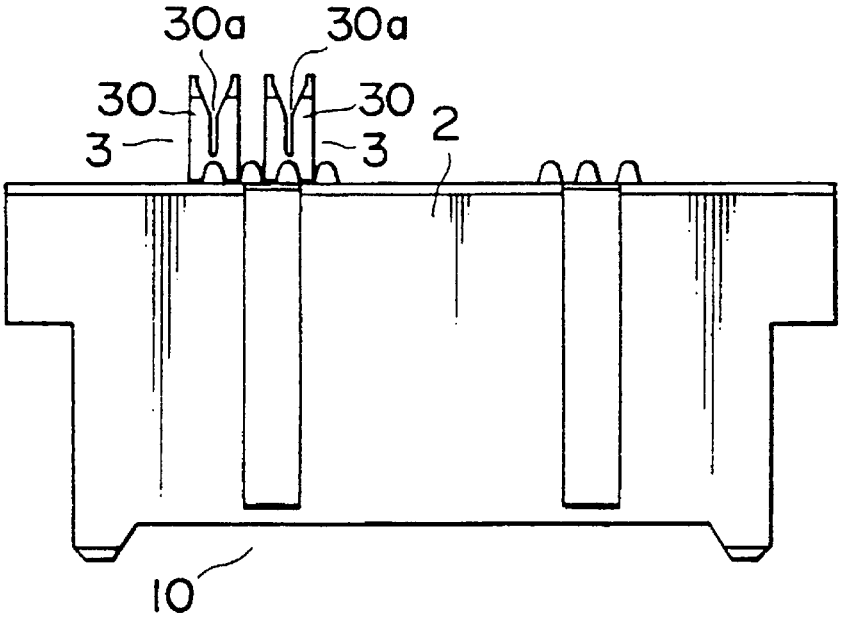
Figure 7A:
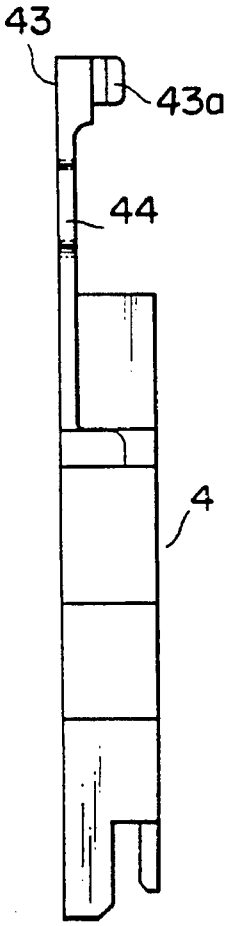
FIGS. 7(*a*) and 7(*b*) are a side view and a plan view of a cover member of the interface connector illustrated in FIG. 5.
Figure 7B:
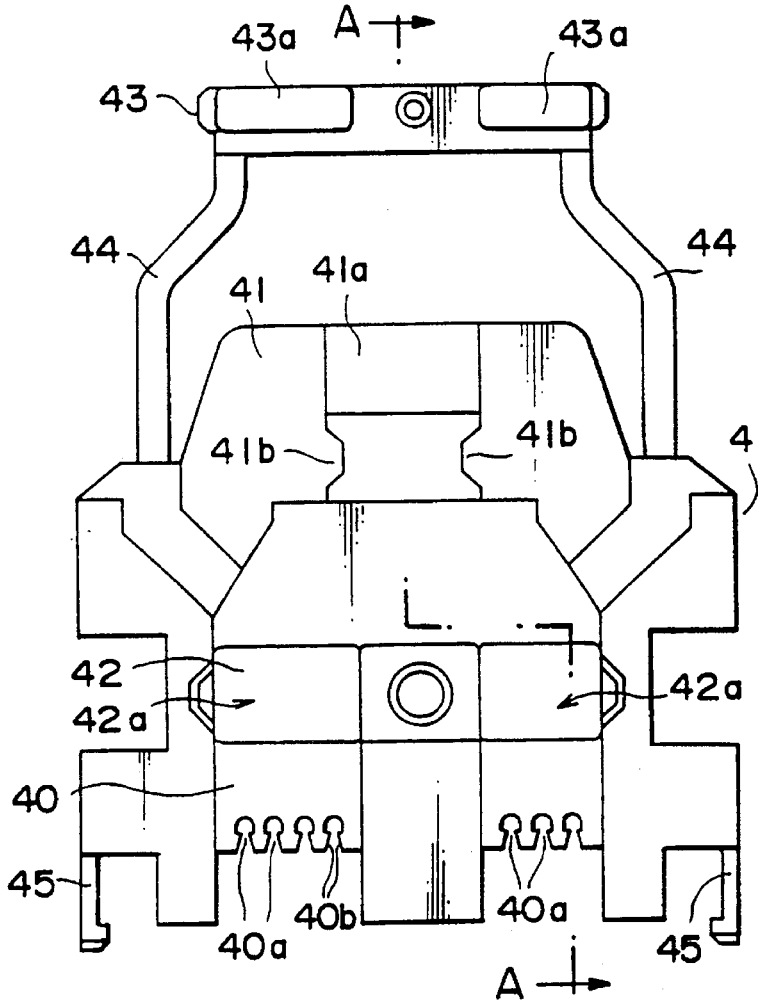
Figure 8:
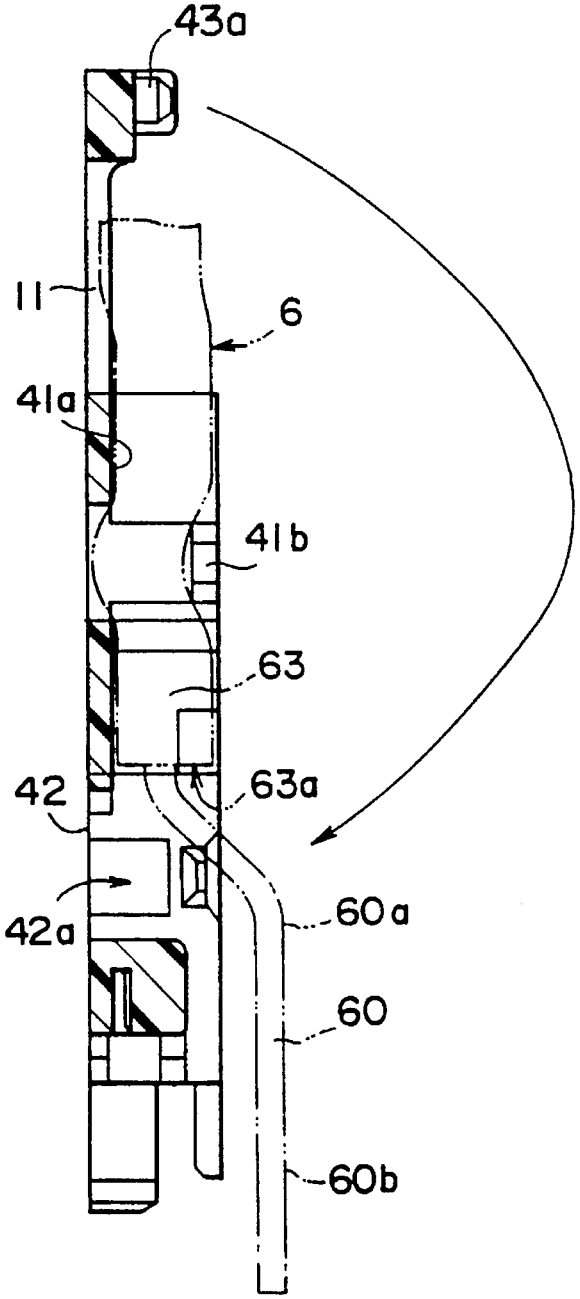
FIG. 8 is a sectional view of the cover member, taken along a line A—A in FIG. 7.

A combination of the base member 2 and the contact elements 3 fixed thereto forms a connector body 10 illustrated in FIG. 6.

The connector of this embodiment includes the cover member 4, one in number. The cover member 4 comprises an electric wire positioning portion 40, a cable holding portion 41, an electric wire receiving portion 42, an electric wire pushing portion 43, a hinge portion 44, and lock portions 45. These components are formed as an integral unit. The cover member 4 is preferably made of flexible synthetic resin (for example, polyamide resin).

Among those components of the cover member 4, the electric wire positioning portion 40 is located in an area nearest to the base member 2 when the base member 2 and the cover member 4 are coupled to each other. The electric wire positioning portion 40 has a plurality of positioning grooves 40*a*. These positioning grooves 40*a* hold terminal ends 60*b* of one end portions 60*a* of the electric wires 60 projecting from an opening 63*a* of a sheath 63, respectively. The positioning grooves 40*a* hold the terminal ends 60*b* of the electric wires 60 so that the terminal ends 60*b* confront the contact elements 3 fixed to the base member 2, respectively. Each positioning groove 40*a* has latches 40*b* formed at both sides thereof. The latches 40*b* serve to prevent each electric wire 60 from being readily released from the positioning groove 40*a*.

The cable holding portion 41 is coupled through the electric wire receiving portion 42 to the electric wire positioning portion 40. The cable holding portion 41 has a cable holding groove 41*a*. The cable holding groove 41*a* holds the cable 6 in a condition that an end portion of the sheath 63 adjacent the opening 63*a* is compressed. Accordingly, the cable holding groove 41*a* tightly holds the cable 6 at the end portion of the sheath 63 adjacent the opening 63*a*. The cable holding portion 41 further has protrusions 41*b*. The protrusions 41*b* are formed in the vicinity of the cable holding groove 41*a* to prevent the cable 6 from being readily released from the cable holding groove 41*a*.

The electric wire receiving portion 42 is positioned between the electric wire positioning portion 40 and the cable holding portion 41. The one end portions 60*a* of the electric wires 60 projecting from the opening 63*a* of the sheath 63 are placed on the electric wire receiving portion 42. The electric wire receiving portion 42 is provided with recessed portions 42*a*.

The electric wire pushing portion 43 is coupled to the cable holding portion 41 by a bendable hinge portion 44. When the hinge portion 44 is bent towards the electric wire receiving portion 42, the electric wire pushing portion 43 moves towards the electric wire receiving portion 42 to be engaged with the electric wire receiving portion 42. The electric wire pushing portion 43 has protruding portions 43*a*. When the electric wire pushing portion 43 is engaged with the electric wire receiving portion 42, the protruding portions 43*a* are located on the recessed portions 42*a* of the electric wire receiving portion 42 together with remaining parts of the one end portions 60*a* of the electric wires 60 except the terminal ends 60*b*. Accordingly, the remaining parts of the one end portions 60*a* of the electric wires 60 except the terminal ends 60*b* are interposed between the recessed portions 42*a* and the protruding portions 43*a* to be secured therebetween. Thus, the one end portions 60*a* of the electric wires 60 are prevented from being scattered.

The lock portions 45 are formed at both sides of the electric wire positioning portion 40. When the base member 2 and the cover member 4 are coupled to each other, the lock portions 45 are engaged with the engaging portions 20 of the base member 2 to thereby lock the cover member 4 to the base member 2.

Now, description will proceed to an operation of fixedly supporting the cable 6 on the cover member 4.

At first, the cable 6 is inserted into the cable holding groove 41*a* of the cover member 4 with the end portion of the sheath 63 adjacent the opening 63*a* press-fitted in the cable holding groove 41*a*. The cable 6 inserted in the cable holding groove 41*a* is locked by the protrusions 41*b*. Then, the terminal ends 60*b* of one end portions 60*a* of the electric wires 60 projecting from the opening 63*a* of the sheath 63 are press-fitted into the positioning grooves 40*a*, respectively. Thus, the terminal ends 60*b* of the electric wires 60 are positioned. The terminal ends 60*b* of the electric wires 60 located within the positioning grooves 40*a* are locked by the latches 40*b*.

Figure 9:
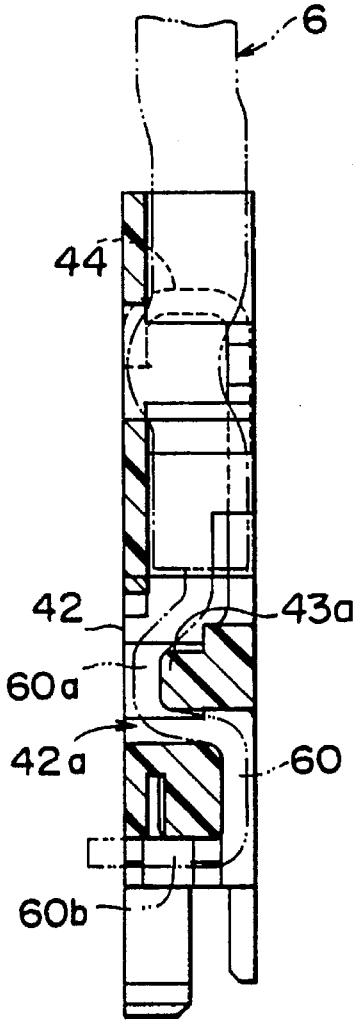
FIG. 9 is a perspective view of the cover member, taken along the line A—A in FIG. 7, with an electric wire pressed by a wire pushing portion against a wire receiving portion.

After the cable 6 is located on the cover member 4 as described above, the hinge portion 44 is bent towards the electric wire receiving portion 42 by 180 degrees, as illustrated in FIG. 9. Consequently, the protruding portions 43*a* of the electric wire pushing portion 43 are located on the recessed portions 42*a* of the electric wire receiving portion 42 together with the one end portions 60*a* (the remaining parts except the terminal ends 60*b*) of the electric wires 60. In this state, the electric wires 60 are forced by the protruding portions 43*a* to be press-fitted into the recessed portions 42*a* so as to prevent the electric wires 60 from being loosened. By the above-described operation, the cable 6 is fixedly supported on the cover member 4.

The above-described operation can be manually carried out without using any jigs. In a subsequent step, the cover member 4 holding the cable 6 as described above is mounted on a jig. By the use of the jig, the connector body 10 illustrated in FIG. 6 is coupled to the cover member 4. At this time, the terminal ends 60*b* of the electric wires 60 held by the positioning grooves 40*a* are connected to the terminal portions 30 of the contact elements 3. If use is made of another jig for bring the contact body 10 into press contact with the cover member 4 and for cutting the terminal ends 60*b* of the electric wires 60, it is possible to carry out connection of the electric wires 60 and cutting of the electric wires 60 at a substantially same time.

Figure 5:
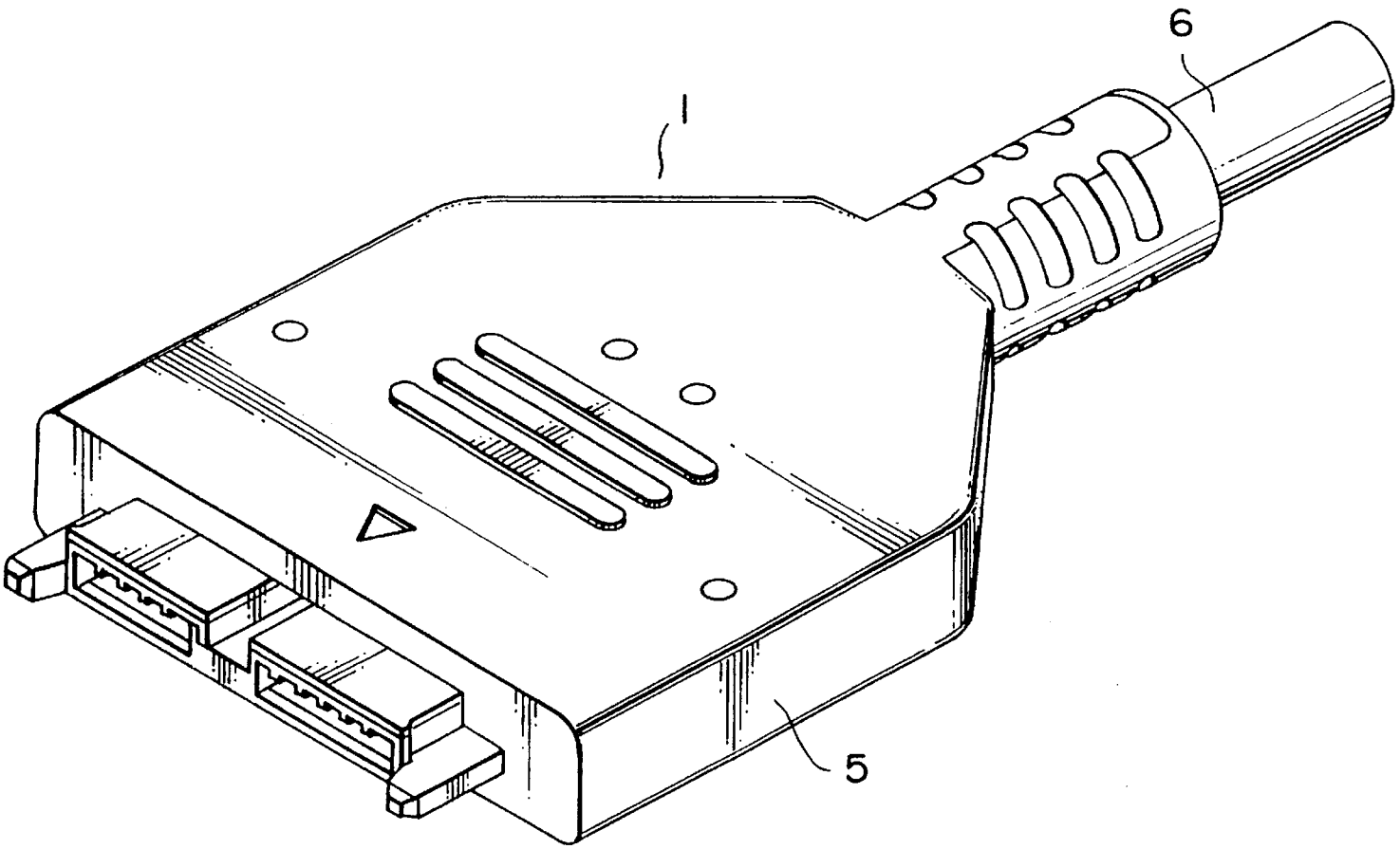
FIG. 5 is a perspective view of an interface connector according to one embodiment of this invention.

In the state where the connector body 10 is coupled to the cover member 4 as described above, the cover member 4 corresponds to the first cover in the above-mentioned second method. In this sense, the cover member 4 serves as a substitution for the primary molding process in the above-mentioned second method. Accordingly, when the outer cover 5 is formed by molding as illustrated in FIG. 5 to surround the connector body 10 and the cover member 4 coupled to each other, assembling of the interface connector of this embodiment is completed.

As described above, it is possible according to this invention to easily and accurately hold the cable at a predetermined position by the cover member without using tools such as jigs, dies, and pins. This simplifies a manufacturing process of the connector. As a result, it is possible to reduce a manufacturing cost of the connector.

What is claimed is:

1. A connector connected to a cable composed of a plurality of electric wires, each of said wires comprising a metal wire covered with an insulator, and a sheath having an opening formed at its terminal end, said sheath covering said electric wires with one end portion of each of said electric wires projecting from said opening, said connector comprising an insulating base member, a plurality of conductive contact elements fixedly supported in said base member, an insulating cover member removably coupled to said base member and covering terminal portions of said contact elements respectively connected to said metal wires, and an outer cover formed by molding plastic material to surround said base member and said cover member, wherein said cover member comprises:

an electric wire positioning portion for holding terminal ends of said one end portions of said electric wires so that said terminal ends confront said contact elements corresponding thereto, respectively;

a cable holding portion for holding said cable at an end portion of said sheath adjacent said opening;

an electric wire receiving portion between said electric wire positioning and said cable holding portions for receiving remaining parts of said one end portions of said electric wires except said terminal ends, each of said remaining parts being between each of said terminal ends of said electric wires and said opening of said sheath; and an electric wire pushing portion for pressing said remaining parts against said electric wire receiving portion.

2. A connector as claimed in claim 1, wherein each of said contact elements is a U-contact element having a slot portion for cutting a corresponding one of said insulators to be brought into press contact with a corresponding one of said metal wires, all of said slot portions cutting said insulators of said electric wires held by said electric wire positioning portion to be connected to said metal wires, respectively, when said cover member and said base member are coupled to each other.

3. A connector as claimed in claim 1, wherein said cover member further comprises a bendable hinge portion for coupling said electric wire pushing portion to said cable holding portion.

4. A connector as claimed in claim 1, wherein said electric wire positioning portion includes positioning grooves for holding said terminal ends of said one end portions of said electric wires so that said terminal ends confront said contact elements, respectively.

5. A connector as claimed in claim 1, wherein said electric wire receiving portion has recessed portions for receiving said remaining parts of said one end portions of said electric wires except said terminal ends, said electric wire pushing portion having protruding portions to be located in said recessed portions together with said remaining parts.

6. A connector as claimed in claim 1, wherein said cable holding portion comprises a cable holding groove for holding said cable at an end portion of said sheath adjacent said opening.

7. A connector as claimed in claim 6, wherein said cable holding portion further includes protrusions for locking said cable held in said cable holding groove.

* * * * *